US008770349B2

(12) United States Patent
Madar

(10) Patent No.: US 8,770,349 B2
(45) Date of Patent: Jul. 8, 2014

(54) SAFETY DEVICES FOR ELEVATORS WITH REDUCED CLEARANCES

(76) Inventor: Yoram Madar, Rishon Lezion (IL)

( * ) Notice: Subject to any disclaimer, the term of this patent is extended or adjusted under 35 U.S.C. 154(b) by 437 days.

(21) Appl. No.: 13/162,692

(22) Filed: Jun. 17, 2011

(65) Prior Publication Data

US 2011/0240413 A1 Oct. 6, 2011

(51) Int. Cl.
*B66B 5/28* (2006.01)

(52) U.S. Cl.
USPC ..... 187/343

(58) Field of Classification Search
CPC ..... B66B 1/32; B66B 1/28; B66B 1/48
USPC ..... 187/343, 305, 373, 306
See application file for complete search history.

(56) References Cited

U.S. PATENT DOCUMENTS

| | | | | |
|---|---|---|---|---|
| 1,911,015 | A * | 5/1933 | Crabbe et al. | 187/316 |
| 7,278,517 | B2 | 10/2007 | Gut et al. | |
| 2008/0245619 | A1 * | 10/2008 | Monzon-Simon et al. | 187/393 |

FOREIGN PATENT DOCUMENTS

| | | |
|---|---|---|
| EP | 1118574 | 7/2001 |
| EP | 1167268 | 1/2002 |
| FI | 117627 | 12/2006 |
| FR | 2912390 | 8/2008 |
| JP | 2005170565 | 6/2005 |
| WO | WO2007122282 | 11/2007 |

OTHER PUBLICATIONS

Machine Translation of EP 1118574.*

* cited by examiner

*Primary Examiner* — William E Dondero
*Assistant Examiner* — Diem Tran
(74) *Attorney, Agent, or Firm* — Michael J. Feigin, Esq.; Feigin & Associates, LLC

(57) ABSTRACT

In an elevator shaft (100), preferably having an anti creeping device (140) and reduced ends, the reduced ends being the elevator pit and the elevator overhead, a load sensing safety apparatus (110) facilitated to activate the emergency safety gear of the elevator, according to teachings of the present invention, the load sensing safety apparatus including a movable plate, one or more spacing devices (120) one or more pressure sensors (150), and a locking trigger mechanism for triggering the activation of the emergency safety gear of the elevator.

16 Claims, 13 Drawing Sheets

SAFETY DEVICES FOR ELEVATORS WITH REDUCED CLEARANCES

RELATED APPLICATION

The present application claims the benefit of IL patent application 200878 filed on Sep. 13, 2009, IL patent application 201002 filed on Sep. 17, 2009 and IL patent application 201903 filed on Nov. 3, 2009, wherein the disclosure of all three aforementioned applications are incorporated herein by reference.

FIELD OF THE INVENTION

The present invention relates to elevators' safety mechanisms and more particularly, the present invention relates to safety assemblies for elevator pits with reduced safety clearance, as well as for elevator overheads with reduced safety clearance. This invention further relates to an elevator apron assembly for use in elevators having an elevator pit with a reduced safety clearance.

BACKGROUND OF THE INVENTION AND PRIOR ART

An elevator shaft is the space enclosed by fireproof walls and elevator doors for the travel of one or more elevators. An elevator shaft has the pit disposed at the bottom end of the shaft and terminates with an overhead disposed at the top end of the shaft.

There are safety requirement that must be followed, when installing an elevator, with regards to the pit and overhead clearances. In particular, when installing a new elevator, overhead and/or pit clearances are provided by rules EN 81-1 and EN 81-2 in Europe and ANSI A17 in the US. And this is as an important and not to be ignored point about safety, as difficult to solve from a technical point of view.

While it is possible (though unlikely) for an elevator's cable to snap, all elevators in the modern era have been fitted with several safety devices which prevent the elevator from simply free-falling and crashing. An elevator cab is typically borne by a set of hoist cables, each of which is capable on its own of supporting the full load of the elevator plus twenty-five percent more weight, with a minimum safety factor 12. In addition, there is a device, typically called the governor, which device detects whether the elevator car is descending or ascending faster than its maximum designated speed. Upon such detection, the governor activates an emergency safety gear, which is an integral part of the car frame, thereby stopping the elevator car quickly, but not so abruptly as to cause injury.

According to elevator law/standards, every passenger elevator must be equipped with a safety gear to prevent free fall of the car, which safety gear, when activated, activates a mechanical lock to lock up the car onto the elevator's guide rails. In order to properly activate the safety gear, every passenger elevator must be equipped with an over speed governor (OSG), which governor senses whenever the car speed exceeding its designated speed, the OSG activates the safety gear device. Such activation results with a mechanical lock up of the car to onto the elevator's guide rails.

It should be noted that in some cases, the OSG is being used as an anti creeping device, preventing the car from unintended movement ("creeping") in either direction. In such cases, the OSG is being electrically activated by means of a solenoid, and in order to allow normal use of the elevator, the anti creeping solenoid must be electrically energized. That is, whenever the car moves with a de-energized solenoid, the safety gear is automatically activated.

The required safety clearance, between the pit floor and the external bottom surface of the elevator's floor, is designed to prevent a crushing or squeezing of person and to enable a maintenance person, located at the pit, to survive a free fall or unintended movement of the elevator. That safety clearance is quite large and is often difficult to provide the required safety clearance, for example, in an existing building to which an elevator is to be added.

Therefore, there is a need for a safety mechanism for an elevator pit having a reduced safety clearance. Some safety mechanisms for an elevator pit with reduced safety clearance exist in the market. For example, European Patent EP 0725033 shows an elevator car blocking device, mounted in the pit, working directly on the bottom of the elevator car or on the counterweight, and suitable for creating a temporary working place at the pit or at the overhead, respectively. Although being functional and safe, the proposed mechanism is cumbersome, requiring a lot of space not always available in the pit for its double application, which would be quadruple in case of contemporary reduced pit and head, considering that traditional shock absorbers are already present in the pit. The reduced height requires the installation of a supporting pillar to obtain a height allowing a person entrapped to leave the pit and not only to take cover. Furthermore, the proposed mechanism is electrically complex, requiring a special harness to be combined with the elevator control board harness However, the proposed mechanism must be activated manually before entering the shaft and after exiting the shaft.

In another example, European Patent EP 1422182 provides a mechanism that activates the emergency safety gear of an elevator, having a reduced pit, when the distance between the bottom of the elevator car and the bottom of the pit decreases under a minimum safety value, wherein the operation of releasing and/or retracting said mechanism is made by a remote manual operation, performable from outside the elevator shaft. However, the proposed mechanism must be activated manually before entering the shaft and after exiting the shaft.

There is a need for and it would be advantageous to have a mechanism that activates the emergency safety gear of an elevator, whenever a person is in the pit of an elevator shaft or in the overhead of an elevator shaft.

A reduced pit also requires an apron that fit the height of the pit. In general, an apron (also called toe guard) is a safety device which is securely attached to an elevator car and forms a wall extending downwards from the elevator car, on the door side. Should the elevator car stop between floors, a gap is formed between the car and the landing floor, exposing the shaft. The apron is intended to cover the gap and thus prevent a person escaping from the car onto the landing floor, from falling through the gap into the shaft, as well as prevent any body part of a passenger from getting between the car and the landing floor. An apron suited for a reduced pit is in itself very advantageous as it facilitates a very low pit height.

There is therefore a need and it would be advantageous to have an apron that can fold when approaching the pit floor of an elevator shaft.

SUMMARY OF THE INVENTION

The device provided with the present invention is a safety mechanism for an elevator shaft having a pit with reduced safety clearance and/or an overhead with reduced safety clearance. The present invention further provides an elevator apron assembly for use in elevators having an elevator pit with a reduced safety clearance, which apron can be operated with the safety device of the present invention.

A principal intention of the present invention is to provide a safety mechanism for an elevator pit and/or overhead having a reduced safety clearance, the safety mechanism including a movable plate and sensors for detecting motion of the moveable plate. Upon sensing motion of the moveable plate, a locking trigger mechanism activates the emergency safety gear of the elevator, protecting a person situated in the reduced safety clearance in the elevator shaft.

An aspect of the present invention is to adapt the safety mechanism to an elevator shaft having a pit with reduced safety clearance.

An aspect of the present invention is to adapt the safety mechanism to an elevator shaft having an overhead with reduced safety clearance.

In an elevator shaft having reduced ends and preferably an anti creeping device, the reduced ends being the elevator pit and the elevator overhead, a load sensing safety apparatus facilitated to activate the emergency safety gear of the elevator, according to teachings of the present invention, the load sensing safety apparatus including a movable plate, one or more spacing devices one or more pressure sensors, and a locking trigger mechanism for triggering the activation of the emergency safety gear of the elevator, preferably by activating the anti creeping device.

The spacing devices maintain the movable plate at a predesigned distance from the surface of the respective reduced end of the elevator shaft, the elevator being in idle state. The one or more pressure sensors are operatively connected to the movable plate, and when pressure is applied onto the movable plate towards the surface of the respective reduced end of the elevator shaft, the force of the pressure being over a predesigned threshold value, the movable plate moves towards the surface of the respective reduced end and the one or more pressure sensors sense the pressure, thereby activating the locking trigger mechanism. Upon termination of the pressure applied onto the movable plate, the movable plate returns to the distance from the surface of the respective reduced end, as in the idle state.

In preferred embodiments of the present invention, the safety apparatus is disposed at the elevator pit with reduced safety clearance. The spacing devices are biasing elements securely disposed on the floor of the elevator pit, and the movable plate is disposed on the one or more biasing elements. Preferably, the return of the movable plate is performed by the one or more biasing elements.

In preferred embodiments of the present invention, the safety apparatus is disposed at the elevator ceiling with reduced safety clearance. The spacing devices are holding rods securely attached to the elevator ceiling, wherein the holding rods include stoppers for holding the movable plate. Optionally, the holding rods are adjustable. Optionally, the return of the movable plate is performed by the gravity force.

Preferably, the locking trigger mechanism of the load sensing safety apparatus is a solenoid.

Optionally, the locking trigger mechanism is an arm having a first end and a second end, wherein the first end is securely attached to the movable plate, and wherein when the movable plate moves towards the surface of the reduced ends of the elevator shaft, the second end moves to operatively activate the emergency safety gear of the elevator.

Preferably, the load sensing safety apparatus further including an electronic control unit. The electronic control unit activates an alarm upon the sensing of the motion of the movable plate towards the surface of the respective reduced end.

An aspect of the present invention is to provide a foldable apron apparatus mounted onto a bottom portion of an elevator car, used in an elevator having a reduced pit. The foldable apron apparatus includes a pair of sliding rods having a bottom end and a top end, wherein the sliding rods are assembled substantially parallel and substantially vertical to the surface of the floor of the reduced pit, when the bottom end is adjacent to the surface of the floor. A leading groove is formed in each of the sliding rods such that both the leading grooves face each other.

The foldable apron apparatus further includes a pair of leading elements securely attached to the bottom portion of the elevator car, wherein each of the leading elements include an opening and wherein a respective sliding rod can fittingly slide through the opening in the leading element, an enclosing rib securely attached to the bottom portion of the elevator car, and a foldable arrangement of at least one pair of slats. Each of the pair of slats includes an upper slat and a lower slat, wherein the upper slat and the lower slat are pivotally interconnected by a laterally movable axis. The upper slat and the lower slat are pivotally connected to the lower slat of the adjacently above pair of slats by a slidable axis. The slidable axis is fittingly facilitated to slide inside the leading groove. The upper slat of the uppermost slat is pivotally attached to the enclosing rib by a slidable axis. The lower slat of the lowermost slat is pivotally attached to a bottom axis, wherein the bottom axis is securely attached to the sliding rods proximal to the bottom ends.

When the bottom portion of the elevator car is distal from the surface of the floor of the reduced pit, the foldable arrangement of at least one pair of slats is in unfolded state.

When the elevator car descends towards the floor of the reduced pit, the sliding rods make stationary contact with the floor of the reduced pit, the leading elements slide down on the respective sliding rods, thereby exerting downwardly force onto the enclosing rib and onto the slats pivotely disposed therebelow, resisting by the bottom axis, wherein the exerting downwardly force causes the slats to collapse, wherein the slidable axes slide down towards the bottom axis inside the leading grooves, and wherein laterally movable axis move laterally away from the sliding rods, thereby bringing foldable apron to a folded state.

When the elevator car ascends upwards from the floor of the reduced pit, the leading elements slide up on the respective sliding rods, pulling up the enclosing rib and the slats pivotely disposed therebelow, until the foldable apron returns to the unfolded state.

Optionally, the apron apparatus further includes biasing elements operatively coupled with the top ends of the sliding rods, wherein the biasing elements exerts downwardly force on the sliding rods thereby pushing the sliding rods downwardly, and thereby helping the gravity force to bring the foldable apron to the unfolded state.

Optionally, the apron apparatus further includes an electronic control unit. Upon detection of a malfunction of the foldable apron, the electronic control unit operatively activates the emergency safety gear of the elevator.

BRIEF DESCRIPTION OF THE DRAWINGS

The present invention will become fully understood from the detailed description given herein below and the accompanying drawings, which are given by way of illustration and example only and thus not limitative of the present invention, and wherein.

DESCRIPTION OF THE PREFERRED EMBODIMENTS

Figure 1:
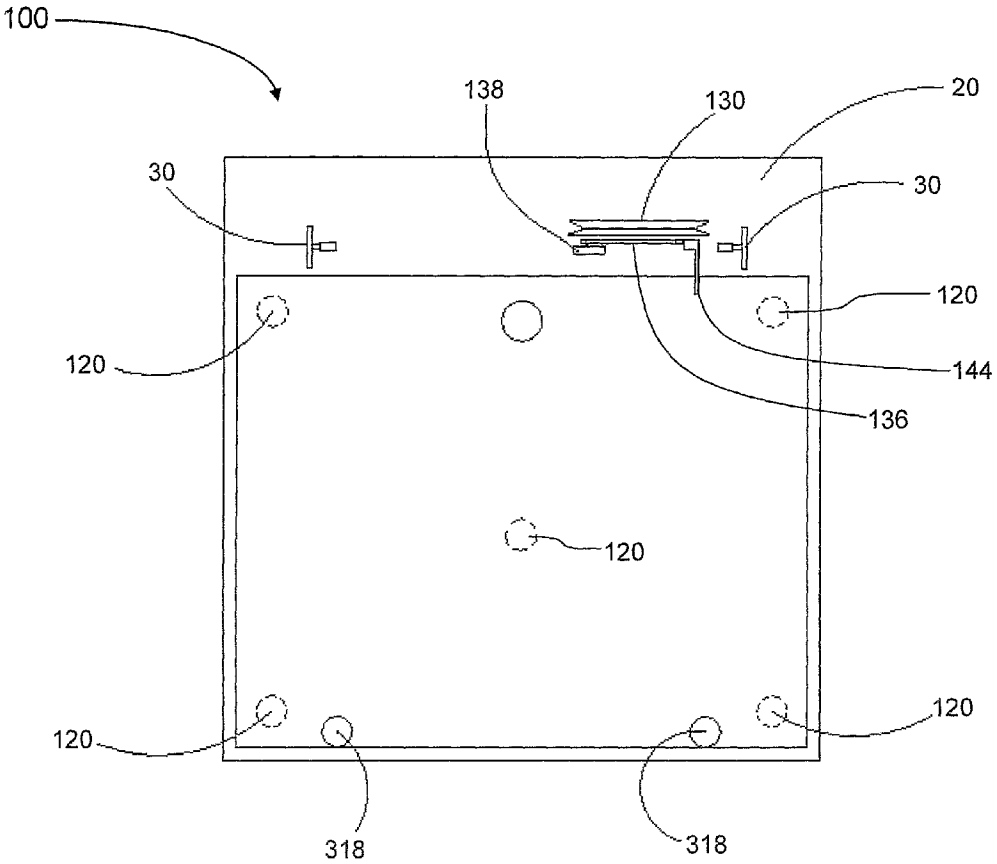
FIG. 1 is a top view schematic illustration of a load sensing floor apparatus for a reduced elevator pit, according to preferred embodiments of the present invention.

Before explaining embodiments of the invention in detail, it is to be understood that the invention is not limited in its application to the details of construction and the arrangement of the components set forth in the host description or illustrated in the drawings.

Unless otherwise defined, all technical and scientific terms used herein have the same meaning as commonly understood by one of ordinary skill in the art of the invention belongs. The methods and examples provided herein are illustrative only and not intended to be limiting.

Figure 2:
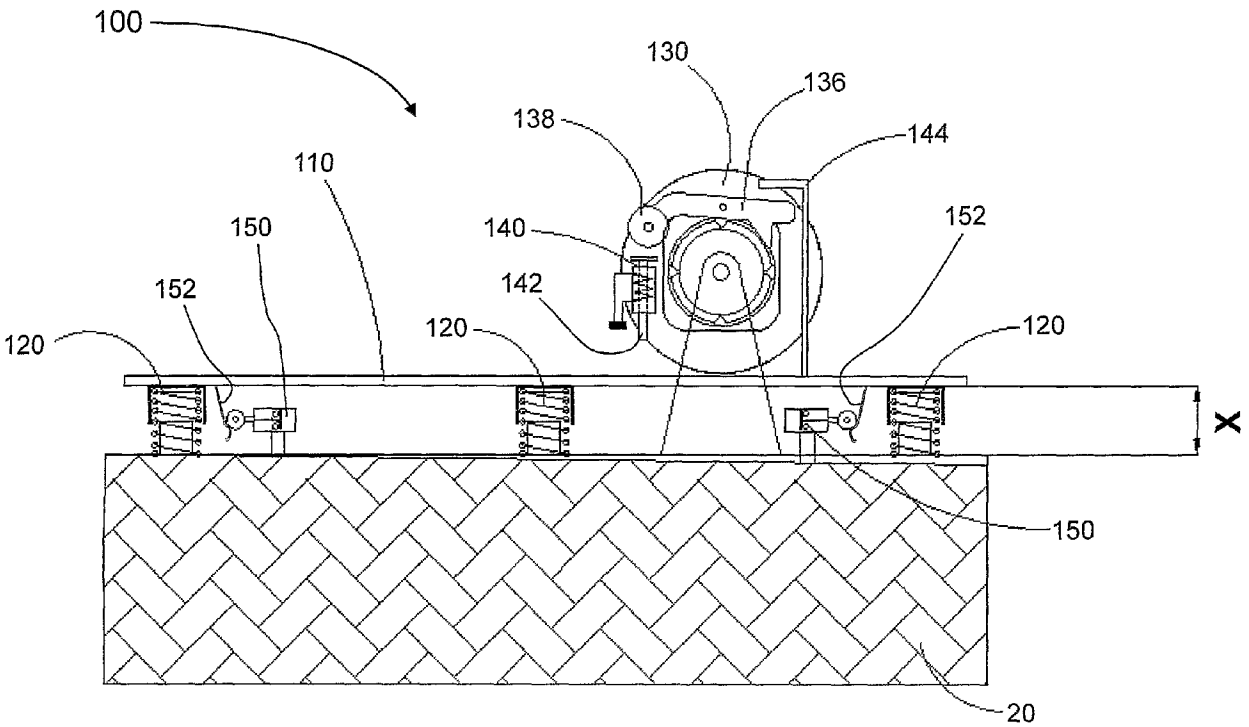
FIG. 2 is a side view schematic illustration of a load sensing floor apparatus for a reduced elevator pit, as shown in FIG. 1, the elevator being in normal operation and stationary.

Reference is now made to the drawings. FIG. 1 is a top view schematic illustration an example of a load sensing safety apparatus 100 for a reduced elevator pit, according to preferred embodiments of the present invention, wherein safety apparatus 100 is disposed on the floor 20 of the pit. Reference is also made to FIG. 2, which is a side view schematic illustration of load sensing safety apparatus 100 for a reduced elevator pit, the elevator being in normal operation and stationary.

Load sensing safety apparatus 100 includes a movable plate 110, used as a floating floor disposed on multiple biasing elements 120, such as coil springs, but not limited to coil springs, wherein biasing elements 120 are disposed on floor 20 of the elevator pit. As long as no force is pressing downwardly on movable plate 110 against one or more biasing elements 120, safety apparatus 100 is in idle state, in which the coupled elevator (not shown) is on normal operation.

Load sensing safety apparatus 100 further includes a locking trigger mechanism such as a solenoid 140 and/or an arm 144, but not limited to solenoid 140 and/or arm 144. Load sensing safety apparatus 100 further includes one or more load sensors 150 that sense downwardly pressing forces applied to movable plate 110 against the one or more biasing elements 120, the force being over a predesigned threshold value.

Figure 3:
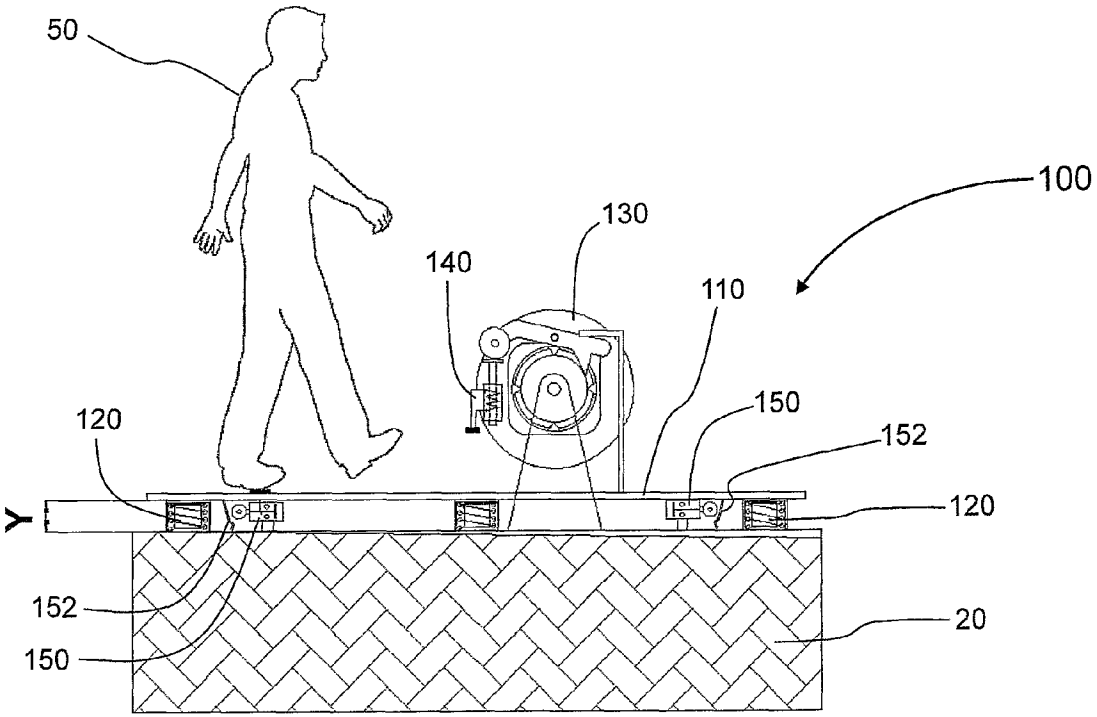
FIG. 3 is a side view schematic illustration of a load sensing floor apparatus for a reduced elevator pit, as shown in FIG. 1, the elevator being in safe state, having a load disposed on top of the floor.
Figure 4:
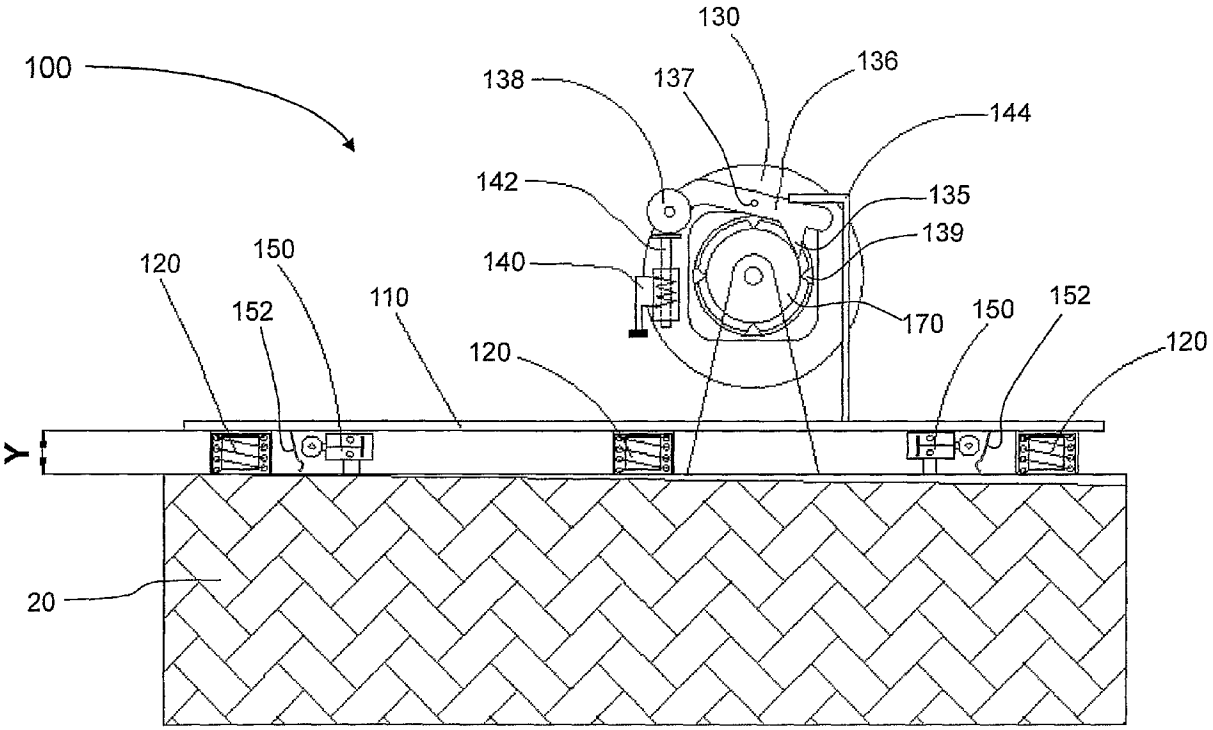
FIG. 4 is a side view schematic illustration of a load sensing floor apparatus for a reduced elevator pit, as shown in FIG. 1, the elevator being in safe state.

Reference is also made to FIG. 3, which is a side view schematic illustration of load sensing safety apparatus 100, having a load 50 disposed on top of movable plate 110, thereby bringing safety apparatus 100 to a safe state. Reference is also made to FIG. 4, which is a side view schematic illustration of load sensing safety apparatus 100, the elevator being in safe state. Upon sensing load 50, the locking trigger mechanism is activated to operatively activate the emergency safety gear of the elevator, to protect a person located in the pit of the elevator shaft. Upon activating the locking trigger mechanism, and thereby activating the emergency safety gear of the elevator, the operational state of the elevator turns into a safe state.

In preferred embodiments of the present invention, the locking trigger mechanism is a solenoid 140, operatively connected to an OSG wheel 130 of the elevator, the OSG being an anti creeping device. FIG. 2 illustrates load sensing safety apparatus 100 for a reduced elevator pit in idle state, having sensed no loads. In the idle state, all load sensors 150 make contact with a contact blade 152, thereby closing an electrical circuit that keeps a plunger 142 of solenoid 140 contracted against some biasing element such as a spring or a piston (not shown), and thereby allowing the elevator to proceed with normal operation. In idle state, the distance of movable plate 110 from floor 20 is X. In the example shown in FIGS. 1-4, plunger 142 is distal from an element 138, for example a wheel, which wheel axis is securely attached to an arm 136, which arm 136 position facilitates normal operation of the elevator. Arm 136 is operatively attached to OSG wheel 130.

When a load is disposed on top of movable plate 110 and the distance of movable plate 110 from floor 20 is reduced to Y, where Y<Pre-determined threshold value, at least one load sensors 150 brakes the contact with the coupling flexible contact blade 152, thereby opening the electrical circuit that keeps a plunger 142 of solenoid 140 operating. As a result, the biasing element pushes plunger 142 forward, thereby pivotely moving arm 136 to lock and thereby OSG wheel 130 from rotating. The locking of OSG wheel 130 causes an immediate activation of the emergency safety gear (typically locking the elevator car onto rails 30), and bringing safety apparatus 100 to a safe state.

Optionally, load sensing safety apparatus 100 further includes an arm 144, which arm 144 is securely attached to movable plate 110. In normal elevator operation, arm 144 is distal from arm 136, which arm 136 position facilitates normal operation of the elevator. When a load is disposed on top of movable plate 110 and the distance of movable plate 110 from floor 20 is reduced to Y, where Y<Pre-determined threshold value, arm 144, that moves with movable plate 110 attached thereto, rigidly contacts arm 136, thereby pivotally moving arm 136 about axis 137 such that, for example, a tooth 135 of arm 136 moves to block a stopper 139, securely attached to and protruding from a rotating pulley 170 of OSG wheel 130 and thereby operatively activating the emergency safety gear of the coupled elevator and bringing safety apparatus 100 to a safe state.

Figure 5:
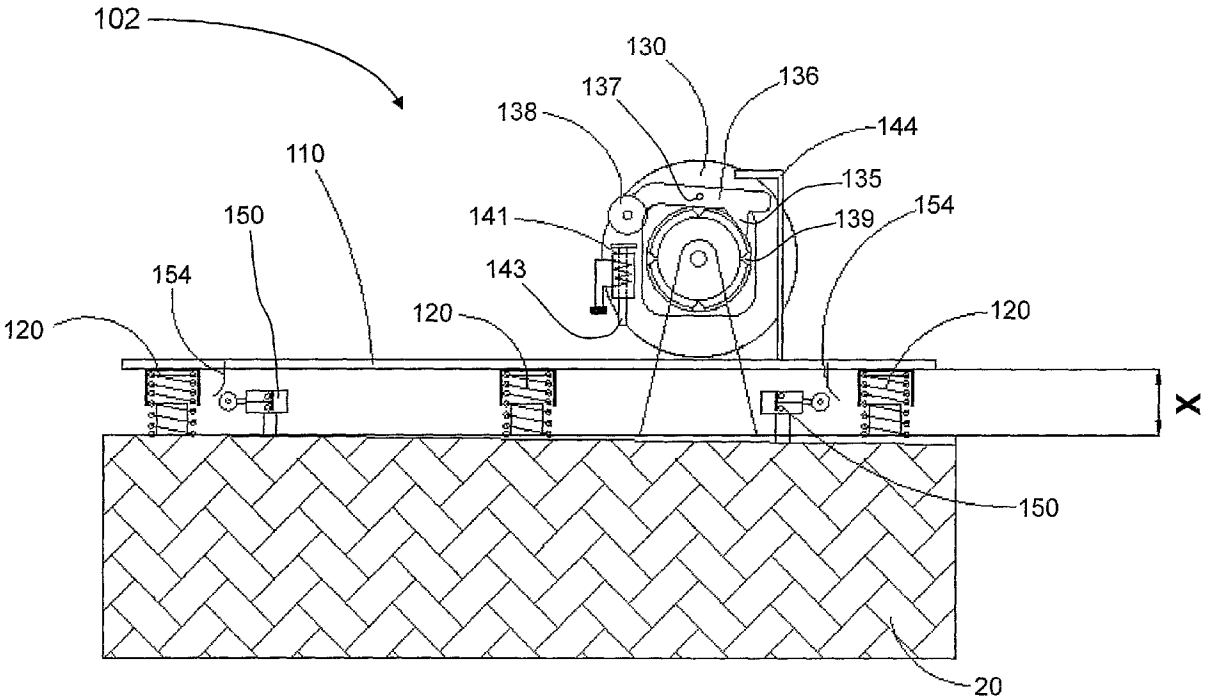
FIG. 5 is a side view schematic illustration of a load sensing floor apparatus for a reduced elevator pit, according to variations of the present invention.

Reference is now made to FIG. 5, which is a side view schematic illustration of load sensing safety apparatus 102, according to variations of the present invention, safety apparatus 102 being in the idle state. In the idle state, all load sensors 150 are detached from flexible contact blade 154, thereby keeping the electrical circuit closed and a plunger 143 of solenoid 141 distal from an element 138, for example a wheel, which wheel axis is securely attached to an arm 136, which arm 136 position facilitates normal operation of the elevator.

When a load is disposed on top of movable plate 110, for example by a maintenance person 50, and the distance of movable plate 110 from floor 20 is reduced to Y, where Y<Predetermined threshold value, at least one load sensors 150 makes contact with the coupling flexible contact blade 154, thereby braking the electrical circuit that moves plunger 143 forward while pivotally moving arm 136 about axis 137 such that, for example, a tooth 135 of arm 136 moves to block a stopper 139 securely attached to and protruding from rotating pulley 170 of OSG wheel 130 and thereby, operatively activating the emergency safety gear of the coupled elevator, and bringing safety apparatus 102 to a safe state.

It should be noted that when the load is taken off movable plate 110, the load sensing safety apparatus (100 and 102) returns to idle state.

Preferably, the load sensing safety apparatus (100 and 102) include an electronic control unit. The electronic control unit controls the operation of various elements of sensing safety apparatus (100 and 102), including sensors 150, solenoid (140 and 141) and optionally, failures detection unit. Upon detection of a malfunction in sensing safety apparatus (100 and 102), the electronic control unit may activate the emergency safety gear of the elevator. Optionally, the electronic control activates an alarm upon sensing of motion of movable plate 110 towards floor 20.

Figure 6:
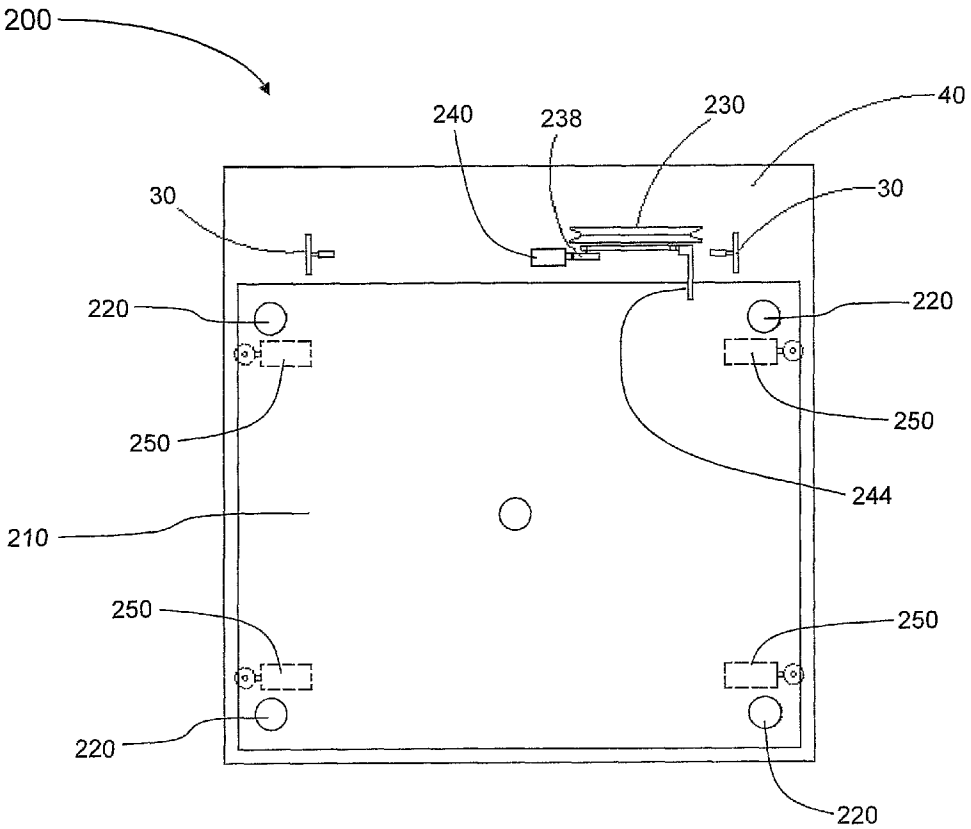
FIG. 6 is a bottom view schematic illustration of a pressure sensing ceiling apparatus for a reduced elevator overhead, according to embodiments of the present invention.
Figure 7:
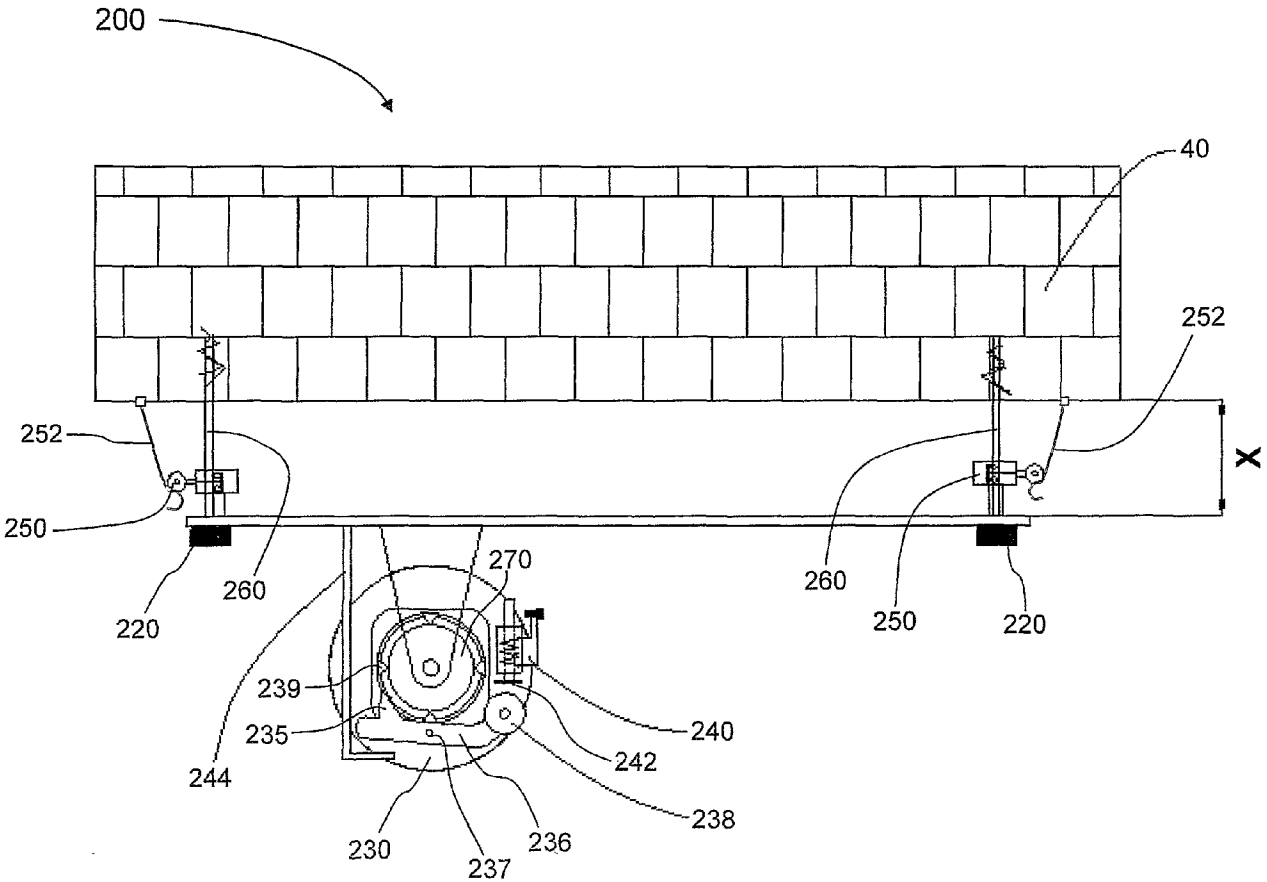
FIG. 7 is a side view schematic illustration of a pressure sensing ceiling apparatus for a reduced elevator overhead, as shown in FIG. 5.

Reference is now made to the drawings. FIG. 6 is a bottom view schematic illustration an example of a load sensing safety apparatus 200 for a reduced elevator overhead of an elevator shaft, according to embodiments of the present invention, wherein safety apparatus 200 is securely disposed adjacently to ceiling 40 of an elevator shaft. Reference is also made to FIG. 7, which is a side view schematic illustration of load sensing safety apparatus 200 for a reduced elevator overhead of an elevator shaft, the elevator being in normal operation and stationary.

Load sensing safety apparatus 200 includes a movable plate 210, used as a floating ceiling disposed on multiple stoppers 220, wherein stoppers 220 are securely attached to ceiling 40 of the elevator shaft by coupling rods 260. As long as no force is pressing upwardly on movable plate 210, safety apparatus 200 is in idle state, in which the coupled elevator (not shown) is on normal operation. Optionally, stoppers 220 and or coupling rods 260 are adjustable, facilitation placing movable plate 210 at a desired distance from ceiling 40.

Load sensing safety apparatus 200 further includes a locking trigger mechanism such as a solenoid 240 and/or an arm 244, but not limited to solenoid 240 and/or arm 244. Load sensing safety apparatus 200 further includes one or more load sensors 250 that sense upwardly pressing forces applied to movable plate 210, the force being over a predesigned threshold value. Upon sensing an upwardly pressing force, the locking trigger mechanism is activated whereby the emergency safety gear of the elevator, to protect a person located in the elevator shaft, between the upper surface of the elevator roof and the ceiling of the elevator shaft.

In preferred embodiments of the present invention, the locking trigger mechanism is a solenoid 240, operatively connected to a governor 230 of the elevator, governor 230 being an anti creeping device. FIG. 7 illustrates load sensing safety apparatus 200 for a reduced elevator overhead in idle state, in which state no upwardly pressing force is sensed. In the idle state, all load sensors 250 make contact with a flexible contact blade 252, thereby closing an electrical circuit that keeps a plunger 242 of solenoid 240 contracted against some biasing element such as a spring or a piston (not shown), and thereby allowing the elevator to proceed with normal operation. In idle state, the distance of movable plate 210 from ceiling 40 is X. In the example shown in FIGS. 6-7, plunger 242 is distal from an element 238, for example a wheel, which wheel axis is securely attached to an arm 236, which arm 236 position facilitates normal operation of the elevator. Arm 236 is operatively attached to governor 230.

When an upwardly pressing force is applied to movable plate 210, for example by a maintenance person 50, and the distance of movable plate 210 from ceiling 40 is reduced to value bellow a pre-determined threshold value, at least one load sensors 250 brakes the contact with the coupling flexible contact blade 252, thereby opening the electrical circuit that keeps a plunger 242 of solenoid 240 operating. As a result, the biasing element pushes plunger 242 forward while pivotally moving arm 236 about axis 237 such that, for example, a tooth 235 of arm 236 moves to block a stopper 239 securely attached to protrude from a rotating pulley 270 of governor 230 and thereby operatively activating the emergency safety gear of the coupled elevator (typically locking the elevator to rails 30), and bringing safety apparatus 200 to a safe state.

Optionally, load sensing safety apparatus 200 further includes an arm 244, which arm 244 is securely attached to movable plate 210. In normal elevator operation, arm 244 is distal from arm 236, which arm 236 position facilitates normal operation of the elevator. When an upwardly pressing force is applied to movable plate 210 and the distance of movable plate 210 from ceiling 40 is reduced to value bellow a pre-determined threshold value, arm 244, that moves with movable plate 210 attached thereto, rigidly contacts arm 236, thereby pivotally moving arm 236 about axis 237 such that, for example, a tooth 235 of arm 236 moves to block a stopper 239 securely attached to protrude from a rotating pulley 270 of governor 230 and thereby operatively activating the emergency safety gear of the coupled elevator and bringing safety apparatus 200 to a safe state.

It should be noted that when the upwardly pressing force applied to movable plate 210 is terminated, load sensing safety apparatus 200 returns to idle state by the gravity force. Preferably, in a transition from safe state to idle state, activated by load sensing safety apparatus 200, elevator will firstly move downwardly.

Preferably, the load sensing safety apparatus 200 include an electronic control. The electronic control unit controls the operation of various elements of sensing safety apparatus 200, including sensors 250, solenoid 240 and optionally, failures detection unit. Upon detection of a malfunction in sensing safety apparatus 200, the electronic control unit may activate the emergency safety gear of the elevator. Optionally, the electronic control activates an alarm upon sensing of motion of movable plate 210 towards ceiling 40.

Figure 8:
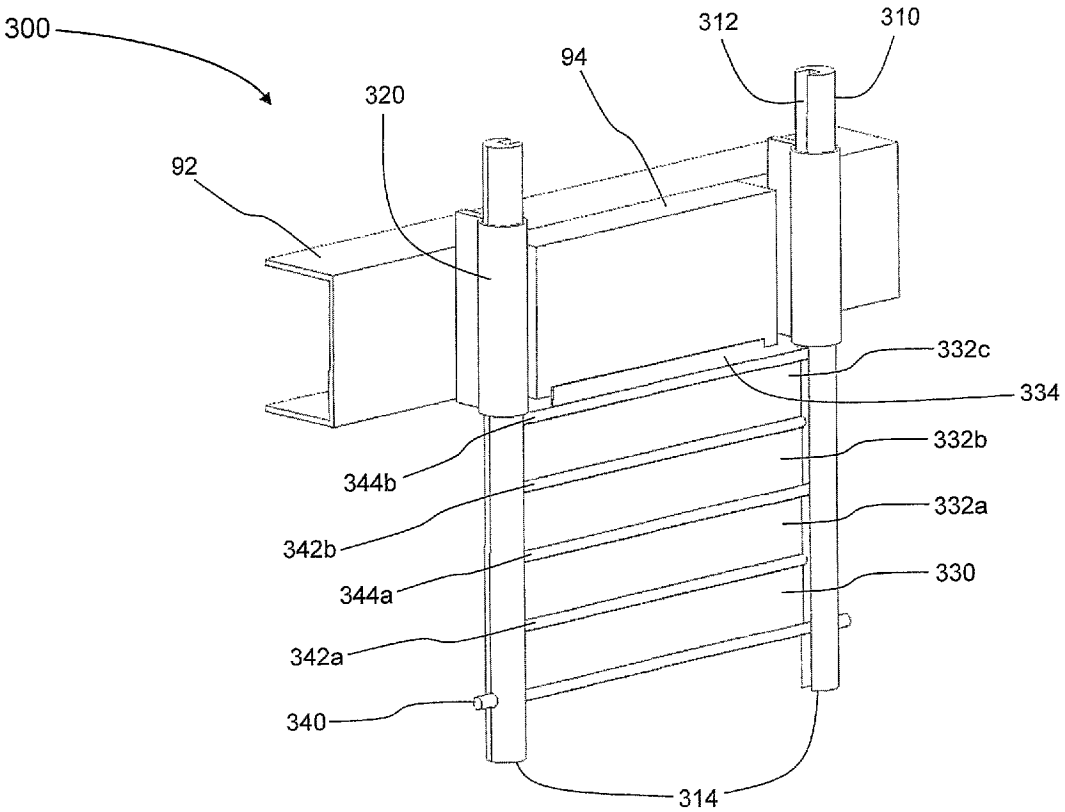
FIG. 8 is a front perspective view illustration of a foldable apron for a reduced elevator pit, according to embodiments of the present invention.
Figure 9:
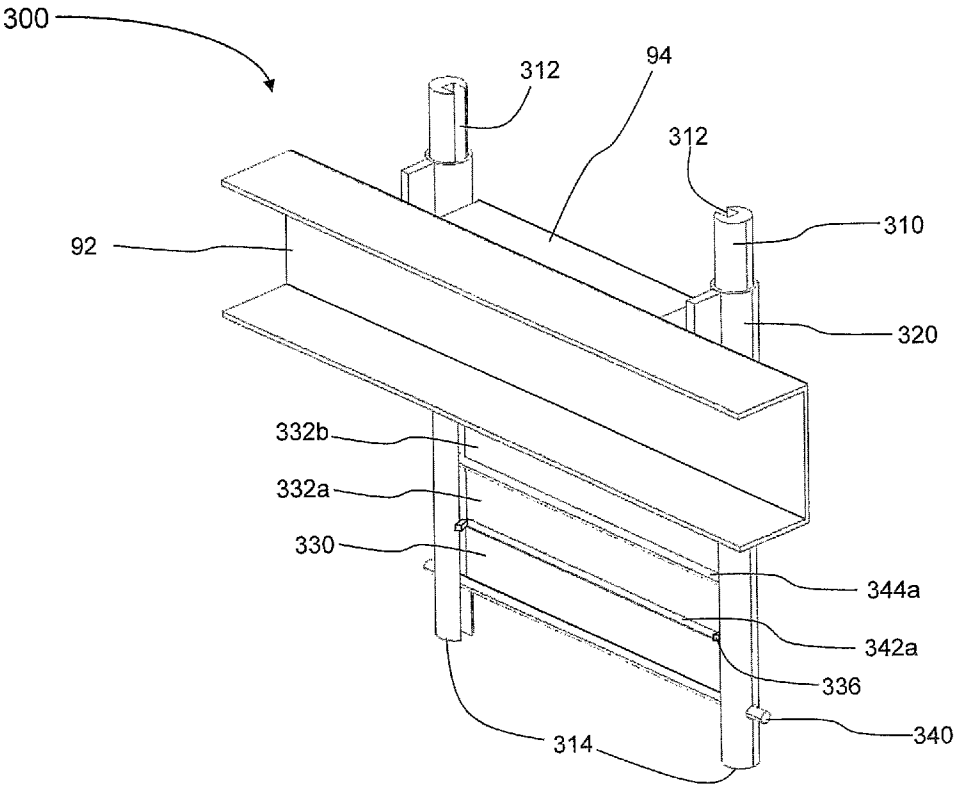
FIG. 9 is a top-back perspective view illustration of the foldable apron for a reduced elevator pit, as shown in FIG. 8.
Figure 10:
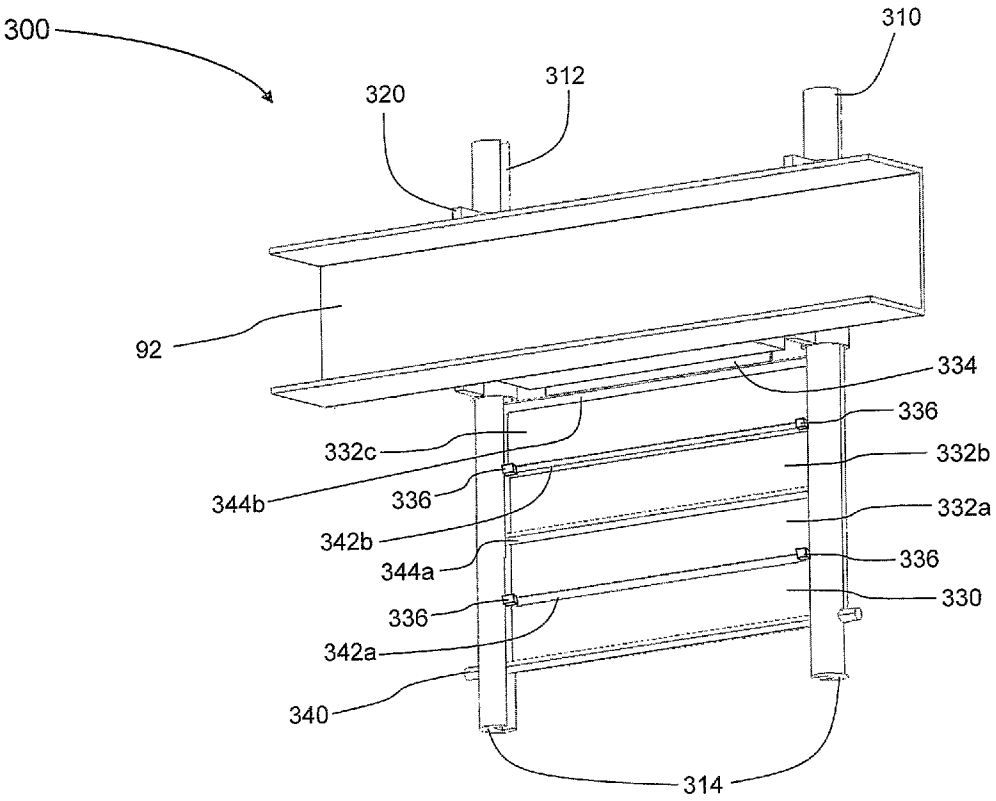
FIG. 10 is a bottom-back perspective view illustration of the foldable apron for a reduced elevator pit, as shown in FIG. 8.
Figure 11:
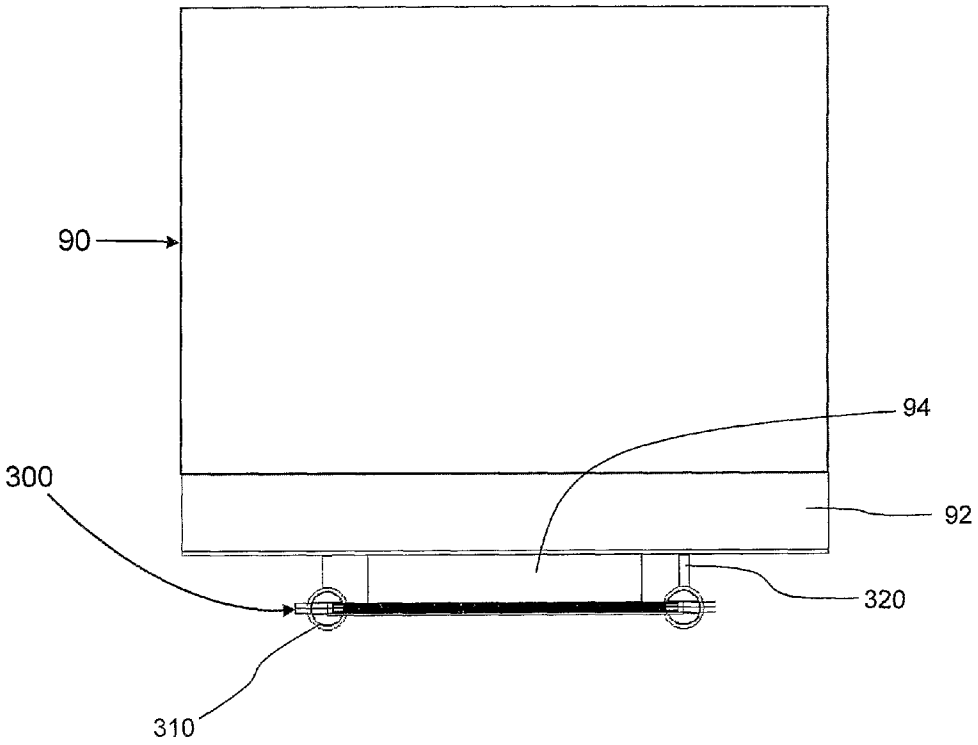
FIG. 11 is a top view illustration of the foldable apron for a reduced elevator pit, as shown in FIG. 8, mounted onto the front of an elevator.

Reference is now made to the drawings. FIG. 8 is a front perspective view illustration of a foldable apron 300 for a reduced elevator pit, according to embodiments of the present invention. Reference is also made to FIG. 9, which is a top-back perspective view illustration of foldable apron 300, to FIG. 10, which is a bottom-back perspective view illustration of foldable apron 300, and to FIG. 11, which is a top view illustration of foldable apron 300, mounted onto the front of an elevator car 90.

Foldable apron 300 includes a pair of sliding rods 310 and respective leading elements 320, which leading elements 320 are securely attached to an entrance floor portion 94 of a bottom portion 92 of elevator car 90.

When assembled, the two sliding rods 310 are substantially parallel and substantially vertical to the surface of floor 20 of the pit (assuming that the line of motion of elevator car 90 is substantially vertical). An opening is formed along leading elements 320 such that a respective sliding rod 310 is fittingly disposed inside the opening, wherein a leading element 320 can operatively move up and down along the respective sliding rod 310. A linear leading groove 312 is formed along in at least the lower portion of sliding rods 310, such that both leading grooves 312 face each other.

Foldable apron 300 further includes a pair of slats, a bottom slat 330 and an upper slat 332*a*. Optionally, foldable apron 300 further includes one or more pairs of slats 332. In the example shown in FIGS. 8-13, with no limitation, foldable apron 300 includes one more pairs of slats 332, bringing the total number of slats to four. Rectangularly shaped slats 330 and 332 have substantially the same width, which width is substantially the distance between sliding rods 310, or slightly smaller. For the sake of clarity, foldable apron 300 may includes any number of pairs of slats 332, as required.

Figure 12B:
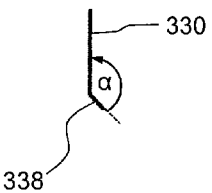
FIG. 12*b* is a side view illustration of the bottom slat of the foldable apron shown in FIG. 12*a;*
Figure 12A:
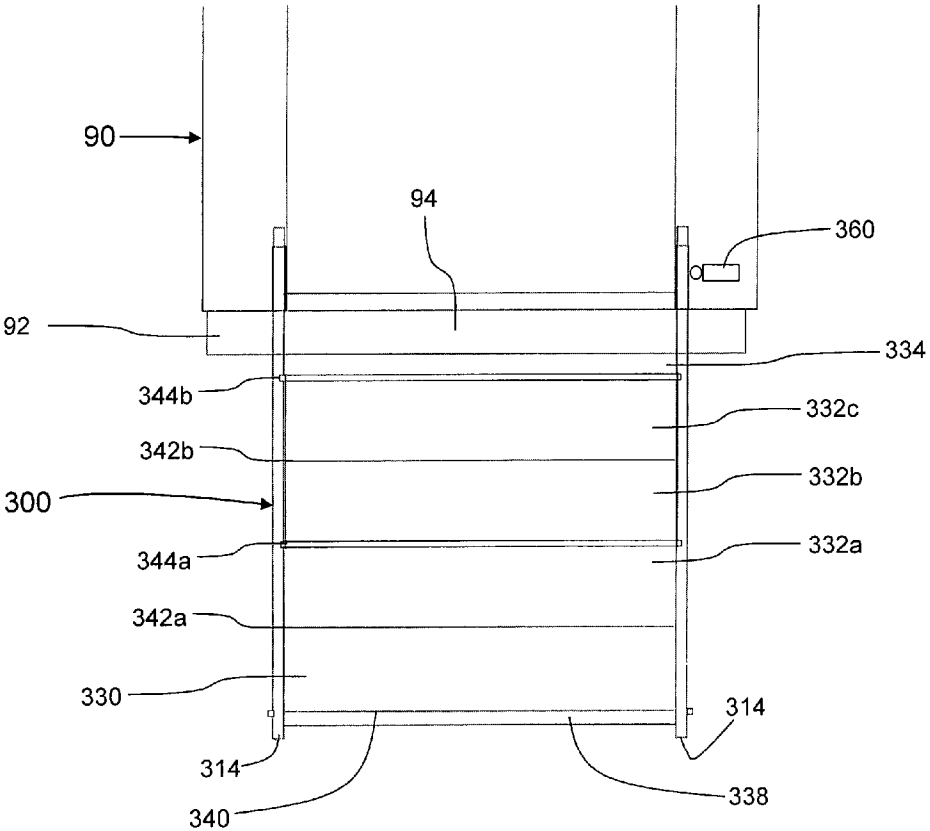
FIG. 12*a* is a front view illustration of the foldable apron for a reduced elevator pit, as shown in FIG. 8, in an unfolded state.
Figure 13B:
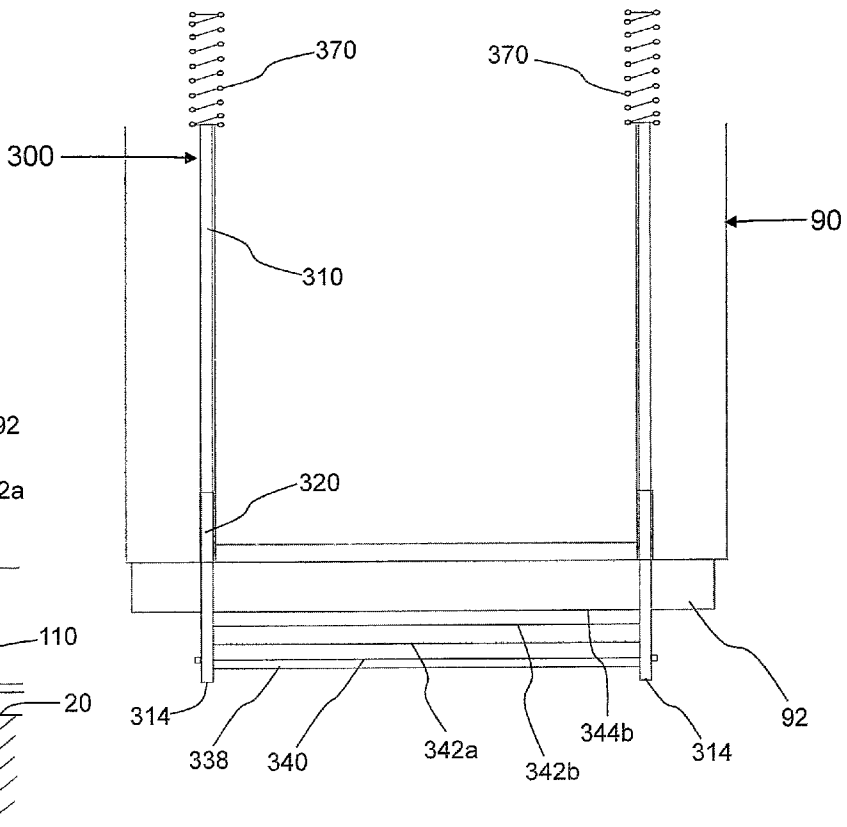
FIG. 13*b* is a front view illustration of the foldable apron shown in FIG. 13*a*.
Figure 13A:
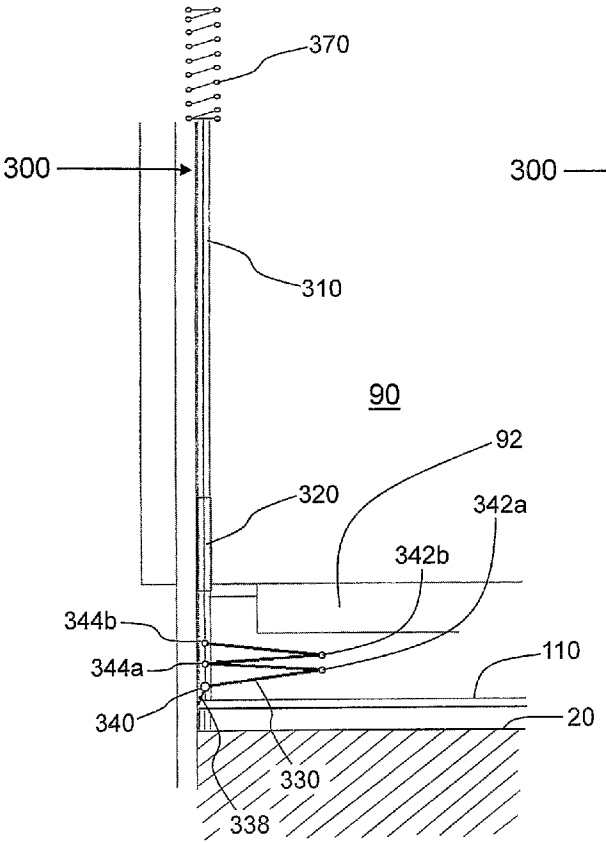
FIG. 13*a* is a side view illustration of the foldable apron for a reduced elevator pit, as shown in FIG. 8, in a folded state.

Reference is also made to FIG. 12*a*, which is a front view illustration of the foldable apron 300, foldable apron 300 being in an unfolded state, to FIG. 13*a*, which is a side view illustration of the foldable apron 300, foldable apron 300 being in a folded state, and to FIG. 13*b*, which is a front view illustration of the foldable apron 300, foldable apron 300 being in a folded state. Bottom slat 330 is pivotally attached to a bottom axis 340, wherein bottom axis 340 is securely attached to sliding rods 310, proximal to the bottom ends 314 of sliding rods 310. Reference is also made to FIG. 12*b*, which is a side view illustration of a variation of bottom slat 330. In the variation shown in FIG. 12*b*, bottom slat 330 includes an extension 338 is required by the international standards), disposed on the bottom edge of slat 330 and which extension 338 extends outwardly forming an angle $\alpha$ with respect to the external surface of bottom slat 330, wherein $\alpha$ is typically an obtuse angle.

The uppermost slat 332 (slat 332*c* in the example shown in FIGS. 8-13) is pivotally attached to a fixed enclosing rib 334, which rib 334 extends from one sliding rod (310) to the other sliding rod (310). Rib 334 encloses the gap formed between the upper edge of uppermost slat 332 and entrance floor portion 94. Typically, slats 330 and 332 have substantially the same height, such that when foldable apron 300 is in an unfolded state, bottom slat 330 and slats 332 substantially enclose the gap between sliding rods 310, to the frill height from the bottom edge of bottom slat 330 up to and including rib 334.

Each upper slat 332 of each pair of slats, including slat 332*a*, is pivotally connected to the lower 332 of the adjacently above pair of slats 332, by a slidable axis 344. The length of each slidable axis 344 is fitted to slide inside grooves 312 of sliding rods 310. The slats of each pair of slats, including slats 330 and 332*a*, are pivotally interconnected by a laterally movable axis 342. Laterally movable axis 342 can operatively move laterally inwardly and back, with respect to the plane formed by sliding rods 310 and with respect to the elevator.

When elevator car 90 is in operation in a shaft having reduced pit and distally from the floor of the pit, foldable apron 300 is in an unfolded state. Should the elevator stop in an elevation above the landing floor level, foldable apron 300 prevents a person escaping from the elevator car onto the landing floor, from falling through the gap into the shaft, as well as prevent any body part of a passenger from getting between the elevator car and the landing floor.

When elevator car 90 descends towards the lowest landing floor level, before reaching the lowest landing floor level, bottom ends 314 of sliding rods 310 reach and make contact with floor 20 of the pit. As elevator car 90 continuous to descends, leading elements 320 slide down on respective sliding rods 310, thereby exerting downwardly force onto rib 334 and onto uppermost slat 332 and onto the rest of the slats, resisted by axis 340 of bottom slat 330. The exerting downwardly force causes slats 330 and 332 to collapse, wherein slidable axes 344 slide down towards axis 340 inside grooves 312 of sliding rods 310, and laterally movable axis 342 move laterally inwardly, with respect to the plane formed by sliding rods 310 and with respect to elevator car 90. The faces of slats 330 and 332 move closer to each other, and slidable axes 344 slide down move closer to axis 340, limited only by the width of the slats. When elevator car 90 reaches the lowest landing floor level, elevator car 90 stops, foldable apron 300 being in the folded state.

Optionally, foldable apron 300 further includes spacers 336 (see FIG. 10) externally disposed on ribs 310, such that spacers 336 do not disturb the slidability of slidable axes 344 and such that spacers 336 keep each pair of slats slightly folded, including in folded state.

When elevator car 90 ascends from the lowest landing floor level, leading elements 320 slide up on the respective sliding rods 310, which sliding rods 310 remain stationary in position due to the force of gravity. As leading elements 320 slide upwardly rib 334 pulls up uppermost slat 332 and the rest of the slats, until slats 330 and 332 return to the unfolded state. Optionally, foldable apron 300 further includes biasing elements 370, such as coil springs, but not limited to coil springs, wherein biasing elements 370 are disposed on top of sliding rods 310. When elevator car 90 descends towards the lowest landing floor level and bottom ends 314 of sliding rods 310 make contact with floor 20 of the pit, biasing elements 370 are loaded. When elevator car 90 ascends from the lowest landing floor level, loaded biasing elements 370 push sliding rods 310 downwardly, thereby helping foldable apron 300 to return to the unfolded state. In variations of the present invention including the extension 338, extension 338 further improve the unfolding of slats 330 and 332

In variations of the present invention, load sensing safety apparatus 100 further includes openings 318 (see FIG. 1) formed in movable plate 110, thereby allowing the bottom portion of sliding rods 310 to move trough respective openings 318, facilitating normal operation of foldable apron 300 without activating load sensing safety apparatus 100.

In variations of the present invention, foldable apron 300 is controlled by a controlled unit. If a sensor 360, operatively connected to the control unit, does not sense that foldable apron 300 is in an unfolded state, the control unit takes safety measure actions such as activating the governor, thereby stopping the elevator quickly, but not so abruptly as to cause injury.

The invention being thus described in terms of embodiments and examples, it will be obvious that the same may be varied in many ways. Such variations are not to be regarded as a departure from the spirit and scope of the invention, and all such modifications as would be obvious to one skilled in the art are intended to be included within the scope of the claims.

What is claimed is:

1. In an elevator including an elevator shaft, the elevator shaft having reduced ends, the reduced ends being an elevator pit and an elevator overhead, a load sensing safety apparatus facilitated to activate emergency safety gear of the elevator, the load sensing safety apparatus comprising:

a) a movable plate;

b) one or more spacing devices;

c) one or more pressure sensors; and d) a locking trigger mechanism for triggering said activation of the emergency safety gear of the elevator, wherein said spacing devices maintain said movable plate at a predesigned distance from a surface of the respective reduced end of said elevator shaft, the elevator being in idle state;

wherein said one or more pressure sensors are operatively connected to said movable plate;

wherein when pressure is applied onto said movable plate towards said surface of said respective reduced end of said elevator shaft, the force of said pressure being over a predesigned threshold value, said movable plate moves towards said surface of said respective reduced end and said one or more pressure sensors sense said pressure, thereby activating said locking trigger mechanism; and wherein said locking trigger mechanism is an arm having a first end and a second end, wherein said first end is securely attached to said movable plate, and wherein when said movable plate moves towards said surface of said reduced ends of said elevator shaft, said second end moves to operatively activate the emergency safety gear of the elevator.

2. The safety apparatus as in claim 1, wherein the elevator includes an anti creeping device and wherein said locking trigger mechanism is facilitated to activate the anti creeping device in order to activate the emergency safety gear of the elevator.

3. The safety apparatus as in claim 1, wherein upon termination of said pressure applied onto said movable plate, said movable plate returns to said distance from said surface of said respective reduced end, as in said idle state.

4. The safety apparatus as in claim 3, wherein said return of said movable plate is performed by said one or more biasing elements.

5. The safety apparatus as in claim 3, wherein said return of said movable plate is performed by the gravity force.

6. The safety apparatus as in claim 1, wherein said safety apparatus is disposed at said elevator pit.

7. The safety apparatus as in claim 6, wherein said spacing devices are biasing elements securely disposed on the floor of said elevator pit, and wherein said movable plate is disposed on said one or more biasing elements.

8. The safety apparatus as in claim 6, wherein said return of said movable plate is performed by said one or more biasing elements.

9. The safety apparatus as in claim 1, wherein said safety apparatus is disposed at an elevator ceiling.

10. The safety apparatus as in claim 9, wherein said spacing devices are holding rods securely attached to said elevator ceiling, wherein said holding rods include stoppers for holding said movable plate.

11. The safety apparatus as in claim 10, wherein said holding rods are adjustable.

12. The safety apparatus as in claim 9, wherein said return of said movable plate is performed by the gravity force.

13. The safety apparatus as in claim 1, further comprising a solenoid.

14. The safety apparatus as in claim 1 further including an electronic control unit.

15. The method as in claim 14, wherein said electronic control unit activates an alarm upon said sensing of said motion of said movable plate towards said surface of said respective reduced end.

16. In an elevator including an elevator shaft, the elevator shaft having reduced ends, the reduced ends being an elevator pit and an elevator overhead, a load sensing safety apparatus facilitated to activate an emergency safety gear of the elevator, the load sensing safety apparatus comprising:

a) a movable plate;

b) one or more spacing devices;

c) one or more pressure sensors;

d) a locking trigger mechanism for triggering said activation of the emergency safety gear of the elevator; and e) an electronic control unit, wherein said spacing devices maintain said movable plate at a predesigned distance from a surface of the respective reduced end of said elevator shaft, the elevator being in idle state;

wherein said one or more pressure sensors are operatively connected to said movable plate;

wherein when pressure is applied onto said movable plate towards said surface of said respective reduced end of said elevator shaft, the force of said pressure being over a predesigned threshold value, said movable plate moves towards said surface of said respective reduced end and said one or more pressure sensors sense said pressure, thereby activating said locking trigger mechanism; and wherein said electronic control unit activates an alarm upon said sensing of said motion of said movable plate towards said surface of said respective reduced end.

* * * * *